United States Patent [19]

Ringgenberg

[11] Patent Number: 4,657,082

[45] Date of Patent: Apr. 14, 1987

[54] CIRCULATION VALVE AND METHOD FOR OPERATING THE SAME

[75] Inventor: Paul D. Ringgenberg, Duncan, Okla.

[73] Assignee: Halliburton Company, Duncan, Okla.

[21] Appl. No.: 797,375

[22] Filed: Nov. 12, 1985

[51] Int. Cl.[4] ..... E21B 34/10

[52] U.S. Cl. ..... 166/336; 166/386; 166/321; 166/331; 166/374

[58] Field of Search ..... 166/336, 373, 374, 386, 166/250, 264, 167, 169, 320, 321, 331, 240; 175/57

[56] References Cited

U.S. PATENT DOCUMENTS

| | | | |
|---|---|---|---|
| 3,051,240 | 8/1962 | Fisher, Jr. | 166/331 |
| 3,823,773 | 7/1974 | Nutter | 166/250 X |
| 3,850,250 | 11/1974 | Holden et al. | 166/95 X |
| 3,891,033 | 6/1975 | Scott | 166/133 |
| 3,897,825 | 8/1975 | Tausch | 166/336 |
| 3,930,540 | 1/1976 | Holden et al. | 166/336 |
| 3,970,147 | 7/1976 | Jessup et al. | 166/250 |
| 3,986,554 | 10/1976 | Nutter | 166/240 X |
| 4,063,593 | 12/1977 | Jessup | 166/317 |
| 4,064,937 | 12/1977 | Barrington | 166/162 |
| 4,105,075 | 8/1978 | Helmus | 166/321 |
| 4,113,012 | 9/1978 | Evans et al. | 166/264 |
| 4,258,793 | 3/1981 | McGraw et al. | 166/323 X |
| 4,324,293 | 4/1982 | Hushbeck | 166/317 |
| 4,328,866 | 5/1982 | Zimmerman | 166/317 |
| 4,355,685 | 10/1982 | Beck | 166/240 |
| 4,403,659 | 9/1983 | Upchurch | 166/374 |
| 4,452,313 | 6/1984 | McMahan | 166/373 |
| 4,474,242 | 10/1984 | Upchurch | 166/323 |
| 4,498,536 | 2/1985 | Ross et al. | 166/250 |

OTHER PUBLICATIONS

Halliburton Services Drawing 615.4121.

*Primary Examiner*—Stephen J. Novosad
*Assistant Examiner*—William P. Neuder
*Attorney, Agent, or Firm*—Joseph A. Walkowski; Alan T. McCollum

[57] ABSTRACT

Pressure operated circulation valve and method for using the same. A cylindrical housing has an open longitudinal passageway therethrough and a circulation port disposed through a wall thereof. A valve mandrel is slidably received in the housing and is moveable between a position in which fluid may be circulated only between the passageway and the exterior of the housing, a position in which fluid may be circulated only between the exterior of the housing and the passageway, and a position in which fluid may not be circulated in either direction. An annular piston is operatively connected to the valve mandrel and has a first side exposed to pressure exterior of the housing and a second side expose to pressure interior of the housing to permit movement of the valve mandrel to its various positions by application of pressure to the interior and exterior of the housing.

16 Claims, 10 Drawing Figures

CIRCULATION VALVE AND METHOD FOR OPERATING THE SAME

The present invention relates generally to apparatus and methods for testing an oil well, and more particularly, but not by way of limitation, to a circulation valve which may be placed in a circulating condition or closed in response to annulus and drill string pressure.

The prior art includes a number of sliding sleeve type circulation valves which are opened in response to annulus pressure. Typically once open, a prior art valve remains locked in an open condition. Examples of such are U.S. Pat. No. 4,064,937 to Barrington and U.S. Pat. No. 3,970,147 to Jessup et al. There are however exceptions. U.S. Pat. No. 4,452,313 to McMahan discloses a circulation valve which may be initially opened by pressurizing the well annulus and which may subsequently be reclosed and reopened by setting down weight on the circulation valve or picking up weight from the circulation valve.

U.S. Pat. No. 4,403,659 issued to Upchurch discloses a pressure controlled reversing valve which is opened in response to a predetermined number of pressure increases and decreases in the drill string. After the Upchurch circulating valve is open, increasing the rate of flow through the drill string into the annulus closes the valve which may be again reopened by applying the predetermined number of internal pressure increases and decreases. When the Upchurch circulation valve is open, liquids cannot be spotted in the well bore through the valve at a moderate or high rate since such action closes the valve. If nitrogen is spotted through the valve, it cannot be closed as the nitrogen flow does not effect a large enough pressure drop to cycle the valve.

The present invention provides an improved recloseable circulation valve which may be initially placed in condition for reverse circulation by alternately pumping down the drill string and annulus a predetermined number of times and/or pumping down and releasing pressure in the drill string. Thereafter, pumping down of the drill string places the valve in condition for spotting fluids in the well bore through the valve after which pumping down the annulus closes the valve. The term "pumping down" the annulus or drill string, as used herein, is employed to describe the increasing of pressure and/or flow in the annulus or drill string, as the case may be.

The circulation valve of the instant invention comprises a cylindrical housing having an open longitudinal passageway therethrough and a circulation port disposed through a wall thereof. The valve mandrel is slideably received in the housing and is moveable between a first position closing the circulation port and a second position in which fluid may be circulated through the port. Annular piston means received in the housing are operatively connected to the valve mandrel and include a first side subject to pressure in the well bore annulus and a second side subject to pipe string pressure. The piston means move the valve mandrel toward one of the positions when the pressure on the first side exceeds the pressure on the second side and move the valve mandrel toward the other of the positions when the pressure on the second side exceeds the pressure on the first side.

Numerous objects, features and advantages of the present invention will be readily apparent to those skilled in the art upon a reading of the following disclosure when taken in conjunction with the accompanying drawings.

FIG. 1 is a schematic elevation view of a typical well testing apparatus using the present invention.

FIGS. 2A–2F an elevational quarter section view showing a downhole tool incorporating the circulation valve of the instant invention.

During the course of drilling an oil well, the borehole is filled with a fluid known as drilling fluid or drilling mud. One of the purposes of this drilling fluid is to contain in intersected formations any fluid which may be found there. To contain these formation fluids the drilling mud is weighted with various additives so that the hydrostatic pressure of the mud at the formation depth is sufficient to maintain the formation fluid within the formation without allowing it to escape into the borehole.

When it is desired to test the production capabilities of the formation, a testing string is lowered into the bore-hole to the formation depth and the formation fluid is allowed to flow into the string in a controlled testing program. Lower pressure is maintained in the interior of the testing string as it is lowered into the borehole. This is usually done by keeping a valve in the closed position near the lower end of the testing string. When the testing depth is reached, a packer is set to seal the borehole thus closing in the formation from the hydrostatic pressure of the drilling fluid in the well annulus. Alternately, the string may be stabbed into a previously set production packer.

The valve at the lower end of the testing string is then opened and the formation fluid, free from the restraining pressure of the drilling fluid, can flow into the interior of the testing string.

The testing program includes periods of formation flow and periods when the formation is closed in. Pressure recordings are taken throughout the program for later analysis to determine the production capability of the formation. If desired, a sample of the formation fluid may be caught in a suitable sample chamber.

At the end of the testing program, a circulation valve in the test string is opened, formation fluid in the testing string is circulated out, the packer is released, and the testing string is withdrawn.

Over the years various methods have been developed to open the tester valves located at the formation depth as described. These methods include string rotation, string reciprocation, and annulus pressure changes. Particularly advantageous tester valves are those shown in U.S. Pat. Nos. 3,856,085 to Holden, et al., 4,422,506 and 4,429,748 to Beck, and 4,444,268 and 4,448,254 to Barrington. These valves operate responsive to pressure changes in the annulus and provide a full opening flow passage through the tester valve apparatus.

The annulus pressure operated method of opening and closing the tester valve is particularly advantageous in offshore locations where it is desirable to the maximum extent possible, for safety and environmental protection reasons, to keeo the blowout preventors closed during the major portion of the testing procedure.

Figure 1:
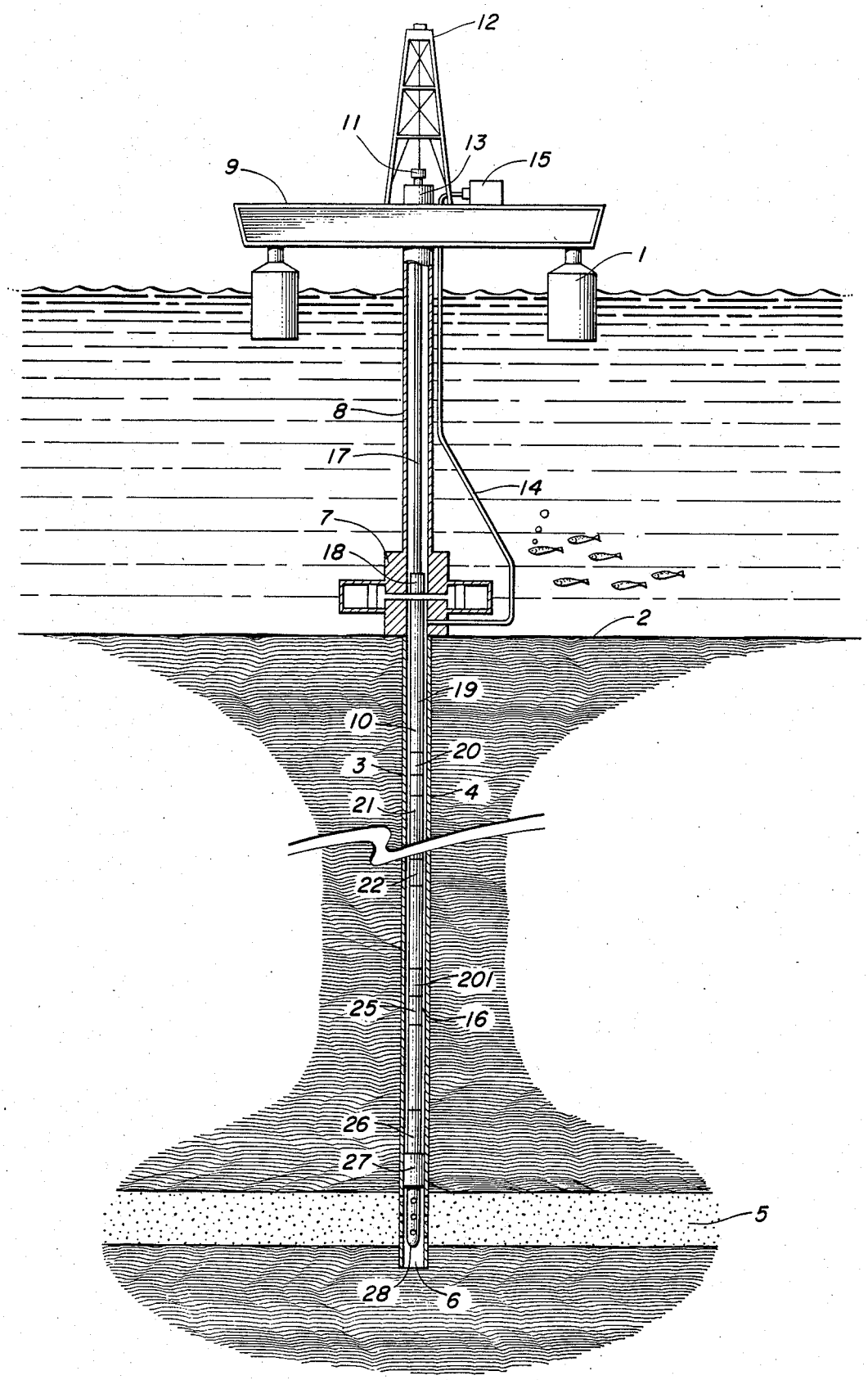

A typical arrangement for conducting a drill stem test offshore is shown in Fig. 1. Such an arrangement would include a floating work station 1 stationed over a submerged work site 2. The well comprises a well bore 3 typically lined with a casing string 4 extending from the work site 2 to a submerged formation 5. The casing string 4 includes a plurality of perforations at its lower end which provide communication between the formation 5 and the interior of the well bore 6.

At the submerged well site is located the well head installation 7 which includes blowout preventor mechanisms. A marine conductor 8 extends from the well head installation to the floating work station 1. The floating work station includes a work deck 9 which supports a derrick 12. The derrick 12 supports a hoisting means 11. A well head closure 13 is provided at the upper end of marine conductor 8. The well head closure 13 allows for lowering into the marine conductor and into the well bore 3 a formation testing string 10 which is raised and lowered in the well by hoisting means 11.

A supply conduit 14 is provided which extends from a hydraulic pump 15 on the deck 9 of the floating station 1 and extends to the well head installation 7 at a point below the blowout preventors to allow the pressurizing of the well annulus 16 surrounding the test string 10.

The testing string includes an upper circuit string portion 17 extending from the work site 1 to the well head installation 7. A hydraulically operated conduit string test tree 18 is located at the end of the upper conduit string 17 and is landed in the well head installation 7 to thus support the lower portion of the formation testing string. The lower portion of the formation testing string extends from the test tree 18 to the formation 5. A packer mechanism 27 isolates the formation 5 from fluids in the well annulus 16. A perforated tail piece 28 is provided at the lower end of the testing string 10 to allow fluid communication between the formation 5 and the interior of the tubular formation testing string 10.

The lower portion of the formation testing string 10 further includes intermediate conduit portion 19 and torque transmitting pressure and volume balanced slip joint means 20. An intermediate conduit portion 21 is provided for imparting packer setting weight to the packer mechanism 27 at the lower end of the string.

It is many times desirable to place near the lower end of the testing string a conventional circulating valve 22 which may be opened by rotating or reciprocation of the testing string or a combination of both or by the dropping of a weighted bar in the interior of the testing string 10. This circulation valve is provided as a back-up means to provide for fluid communication in the event that the circulation valve of the present apparatus should fail to open properly. Also near the lower end of the formation testing string 10 is located a tester valve 25 which is preferably a tester valve of the annulus pressure operated type such as those disclosed in U.S. Pat. Nos. 3,856,085; 4,422,506; 4,429,748; 4,444,268; and 4,448,254. Immediately above the tester valve is located a tool 201 which incorporates the apparatus of the present invention.

A pressure recording device 26 is located below the tester valve 25. The pressure recording device 26 is preferably one of which provides a full opening passageway through the center of the pressure recorder to provide a full opening passageway through the entire length of the formation testing string.

It may be desirable to add additional formation testing apparatus in the testing string 10. For instance, where it is feared that the testing string 10 may become stuck in the borehole 3 it is desirable to add a jar mechanism between the pressure recorder 26 and the packer assembly 27. The jar mechanism is used to impart blows to the testing string to assist in jarring a stuck testing string loose from the bore-hole in the event that the testing string should become stuck. Additionally, it may be desirable to add a safety joint between the jar and the packer mechanism 27. Such a safety joint would allow for the testing string 10 to be disconnected from the packer assembly 27 in the event that the jarring mechanism was unable to free a stuck formation testing string.

The location of the pressure recording device may be varied as desired. For instance, the pressure recorder may be located below the perforated tail piece 28 in a suitable pressure recorder anchor shoe running case. In addition, a second pressure recorder may be run immediately above the tester valve 25 to provide further data to assist in evaluating the well.

Referring now to FIGS. 2A–2F, the pressure operated recloseable circulation valve of the present invention is incorporated in a tool indicated generally at 201.

Tool 201 includes a cylindrical outer housing, generally designated by the numeral 200, having an upper housing adapter 202 which includes threads 204 for attaching tool 201 to the portion of testing string 10 located above tool 201.

At the lower end of housing 200 is a lower housing adapter 206 which includes an externally threaded portion 208 for connection of tool 201 to a portion of test string 10 located below the tool.

Housing 200 further includes an upper housing section 210, an intermediate housing section 212 and a lower housing section 214. The interior of the components making up housing 200 forms a fluid flow passageway 216 axially through tool 201. The various housing sections and the upper and lower adapter are threadably connected to one another via threaded connections as shown in the drawing with each such threaded connection being sealed with O-rings as shown.

Figure 2A:
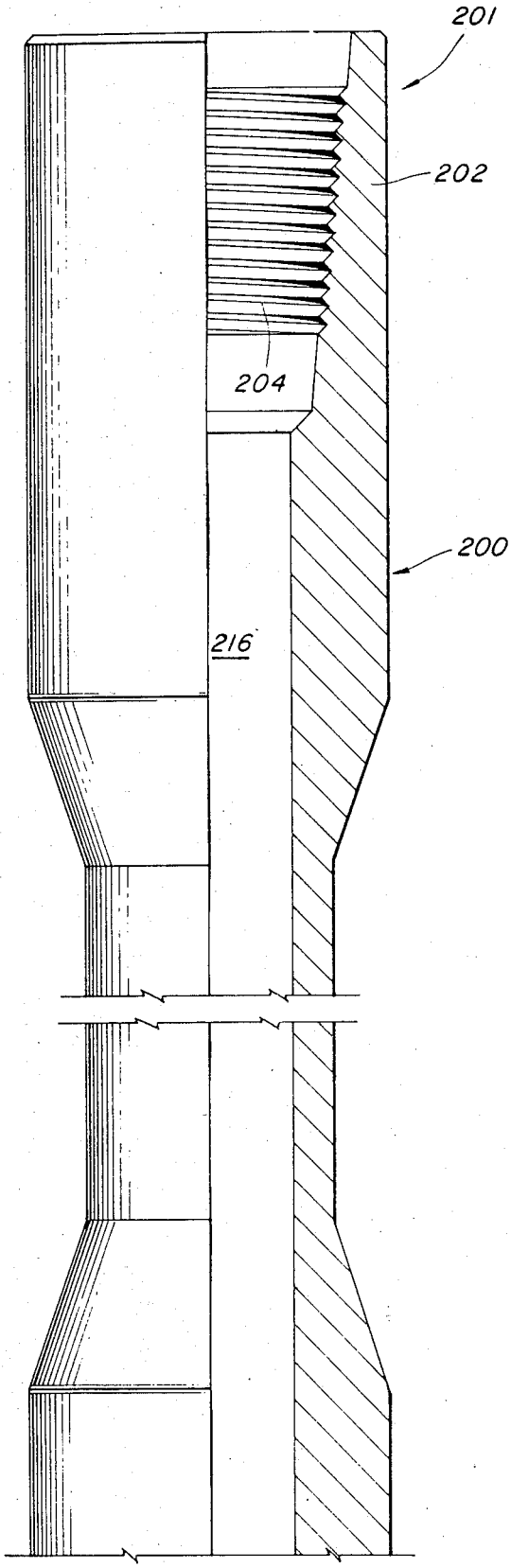
Figure 2B:
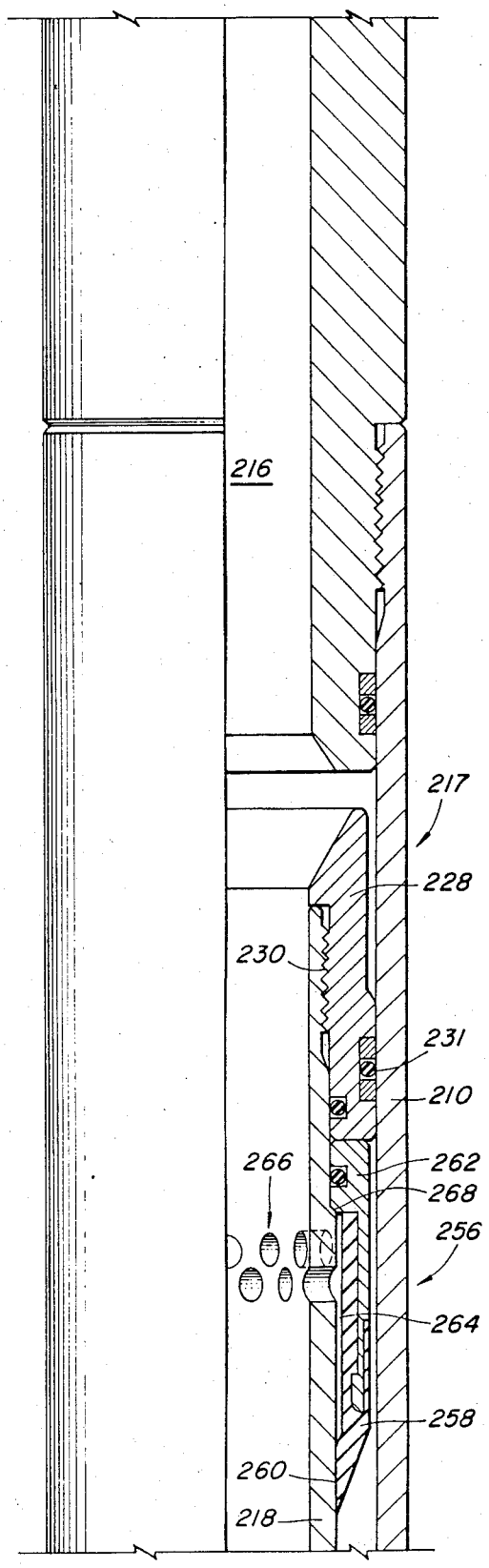
Figure 2C:
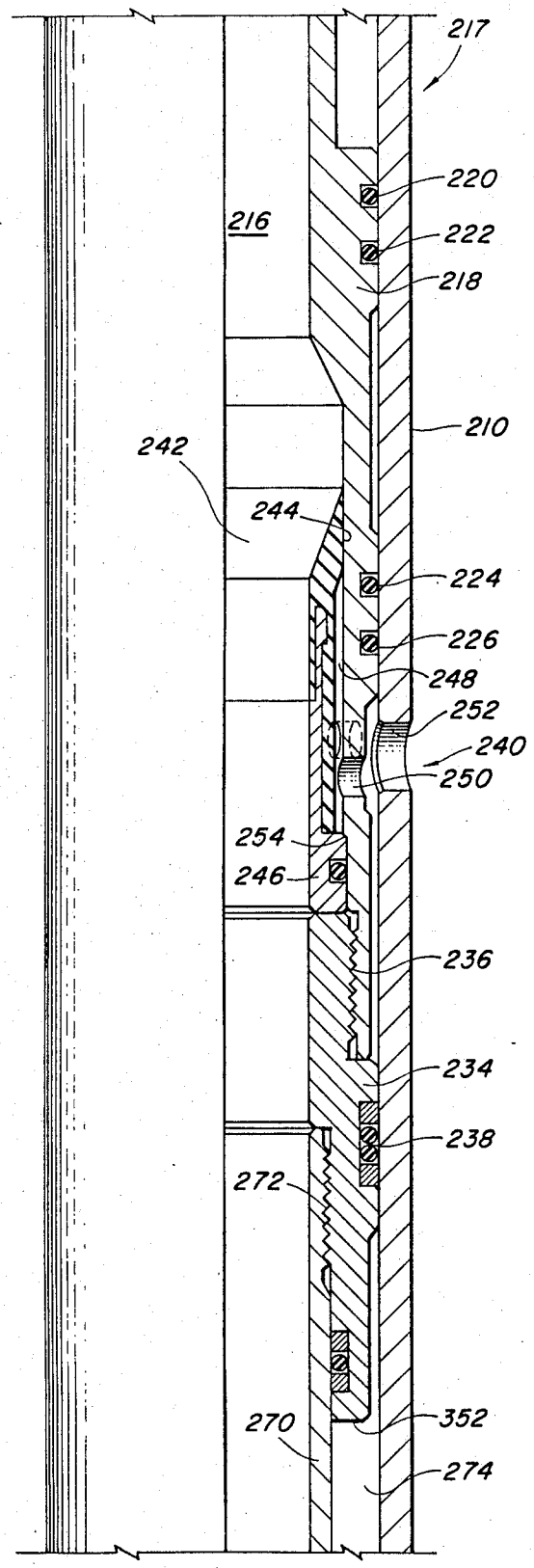

Indicated generally at 217 in FIGS. 2B and 2C is a circulation valve. A generally tubular valve mandrel 218 is closely received within upper housing section 210 and is sealingly engaged therewith via O-rings 220, 222, 224, and 226. An upper valve sleeve 228 is closely received within upper housing section 210 and is threadably engaged via threads 230 to the upper end of valve mandrel 218. An O-ring 231 sealingly engages the radially outer surface of upper valve sleeve 228 to the radially inner surface of upper housing section 210. A lower valve sleeve 234, in FIG. 2C, is threadably engaged via threads 236 to the lower end of valve mandrel 218 and is sealingly engaged thereto via O-ring seal 238.

Valve mandrel 218 includes a lower check valve indicated generally at 240. Included therein is a resiliant valve portion 242, such comprising an annular lip having a radially outer surface 244 which bears against the radially inner surface of valve mandrel 218. Valve portion 242 is inserted over and carried by a valve portion carrier 246. Carrier 246 supports valve portion 242 to create an annular space 248 between the radially outer surface of the valve portion and the radially inner surface of valve mandrel 218. A plurality of bores, one of which is bore 250, are formed through mandrel 210 about the circumference thereof and permit fluid communication between the exterior of the mandrel and space 248. Upper housing section 210 includes a circulating port 252 to permit fluid communication between the interior and exterior of upper housing section 210.

Valve carrier 246 is received between the upper end of lower valve sleeve 234 and a bevel 254 formed on the radially inner surface of valve mandrel 218 and is thus restrained from axial movement relative to the valve mandrel.

In FIG. 2B, an upper check valve is indicated generally at 256. Included therein is a resiliant valve portion 258 having an annular lip which has a radially inner surface 260 that is sealingly engaged against the radially outer surface of valve mandrel 218 about its circumference. Resiliant valve portion 258 is carried by a valve portion carrier 262. A space 264 is formed between the radially inner surface of resiliant valve portion 258 and the radially outer surface of the valve mandrel.

A plurality of bores indicated generally at 266 provide fluid communication between the interior of the valve mandrel 18 and space 264 about the circumference of the valve mandrel. Valve carrier 262 is received between the lower end of upper valve sleeve 228 and a bevel 268 formed on the radially outer surface of valve mandrel 218 about its circumference and is thus restrained from axial movement relative to the valve mandrel.

Figure 2D:
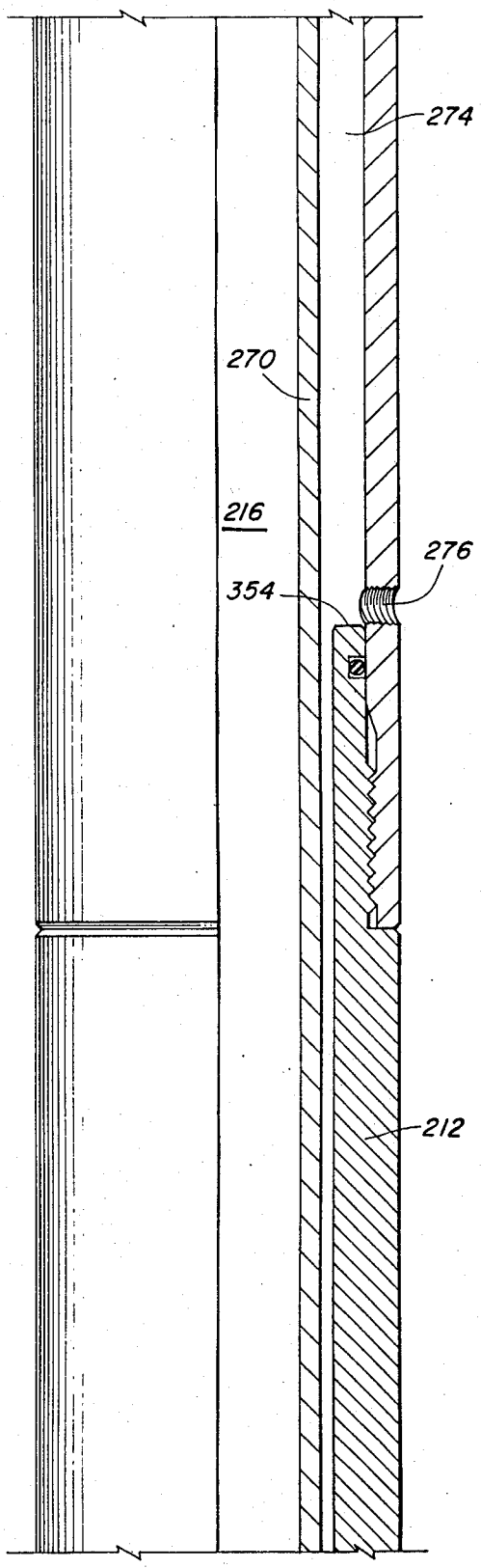
Figure 2E:
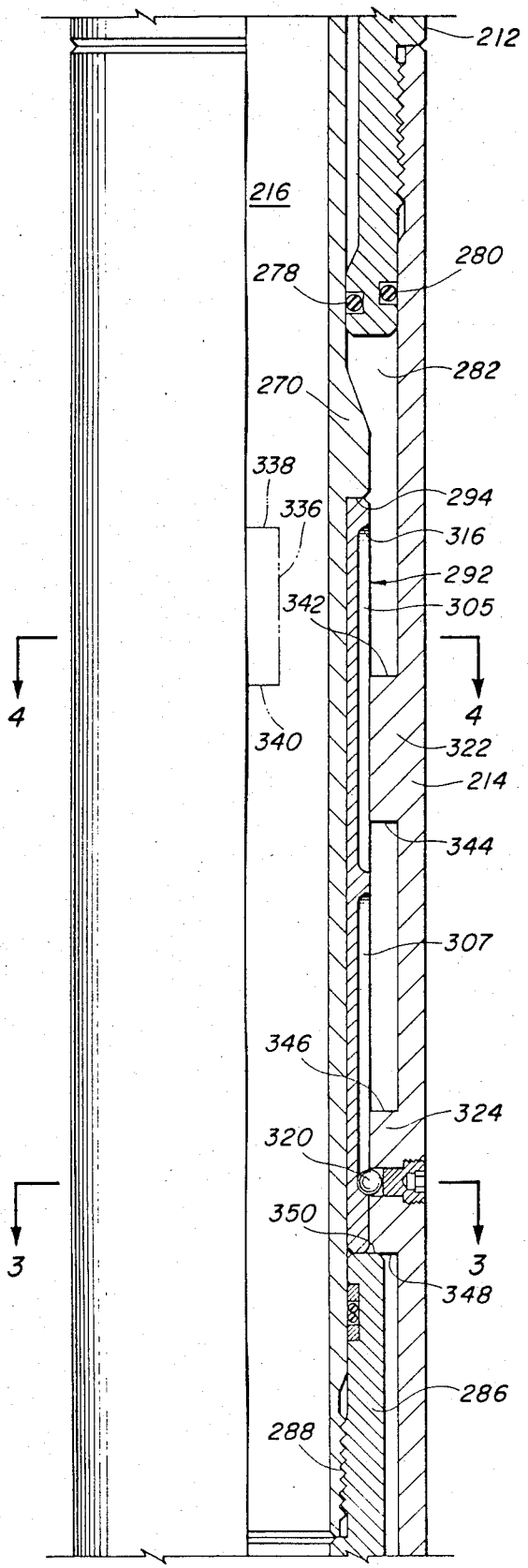
Figure 2F:
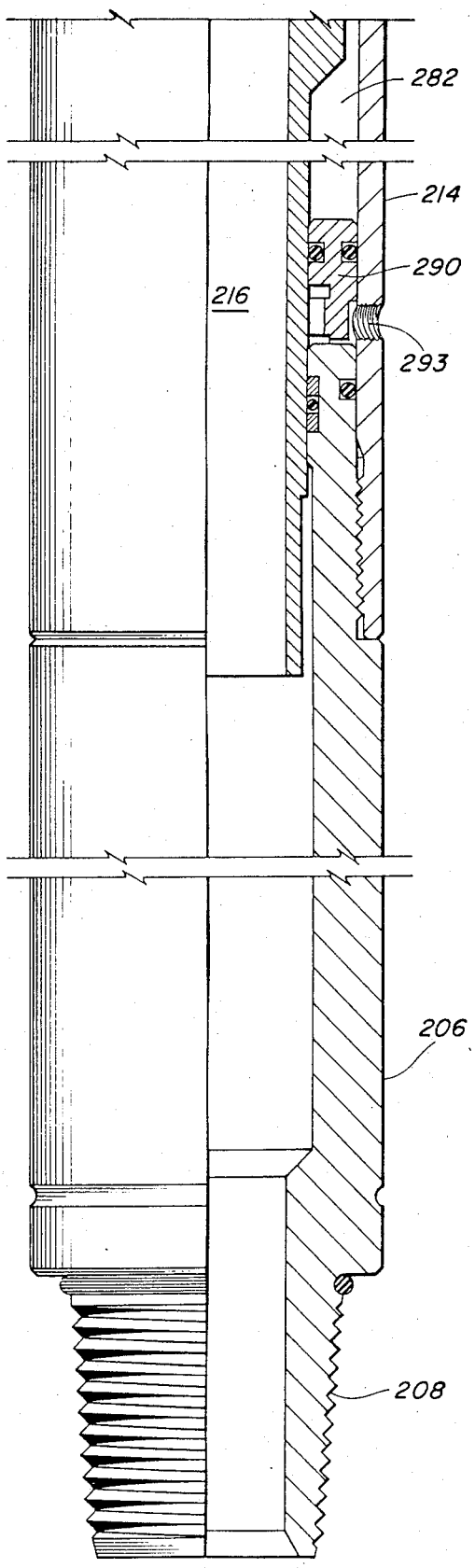

A piston mandrel 270 in FIG. 2C, 2D, and 2E has an upper end threadably secured via threads 272 to the lower end of lower valve sleeve 234. The radially outer surface of piston mandrel 270 and the radially inner surfaces of upper housing section 210 and intermediate housing section 212 define an upper annular space 274 which is in communication with the exterior of the tool via a power port 276. O-rings 278, 280 seal the radially inner and outer surfaces of intermediate housing section 212 and define the lower end of annular space 274. O-rings 278, 280 define the upper end of a lower annular space 282 which has as its outer boundry the radially inner surface of lower housing section 214. The radially inner boundry of space 282 is defined by the outer surface of piston mandrel 270 and the outer surface of a lower piston mandrel 286 which is threadably secured to the lower end of piston mandrel 270 via threads 288.

Disposed at the lower end of annular space 282 is an annular floating piston 290. Piston 290 is sealingly and slidingly received between the radially outer surface of the lower piston mandrel and the radially inner surface of lower housing section 214. Lower annular space 282 is filled with oil to provide lubrication to moving parts, to be hereinafter more fully described, contained within space 282. The lower side of floating piston 290 is in fluid communication with the exterior of tool 201 via a port 292 formed through the wall of lower housing section 214. The floating piston prevents drilling mud and other contaminates in the well bore from becoming mixed with the oil contained in annular space 282 above the floating piston.

In FIG. 2E, an indexing sleeve 292 is closely received over piston mandrel 270 and is restrained from axial movement therealong by a downward facing shoulder 294 formed on mandrel 270 and the upper surface of lower piston mandrel 286. For a better view of the structure associated with indexing sleeve 292, attention is directed to FIG. 5.

An outer cylindrical surface 296 on indexing sleeve 292 concludes a continuous slot or groove, such being indicated generally at 298. Groove 298 includes a repeating zig-zag portion 300 which rotates sleeve 292 counter-clockwise, as viewed from above, upon reciprocation of piston mandrel 270 relative to housing 200.

Groove 298 further includes first and second vertical groove portions 302, 304. Each of groove portions 302, 304 includes an upper and lower leg, like upper leg 305 and lower leg 307 in groove 302. Connecting groove portions 306, 308 connect repeating zig-zag portion 300 with vertical groove portions 302, 304. Zig-zag portion 300 includes a first leg 310 having an upper surface 312 and a lower surface 314. Each of the other legs in zig-zag portion 300 include similar upper and lower surfaces. Likewise, each of vertical grooves 302, 304 include upper and lower surfaces like upper surface 316 and lower surface 318 in groove portion 302.

Figure 5:
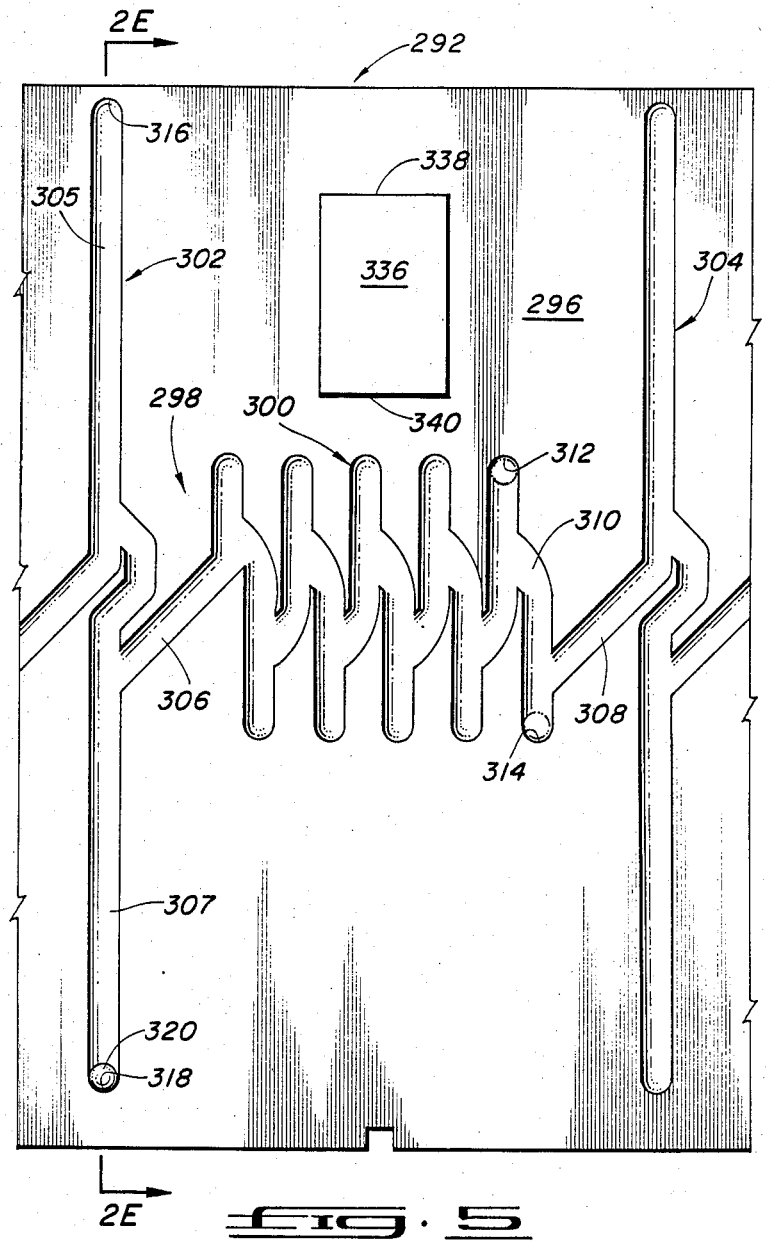
FIG. 5 is a laid-out view of a portion of the indexing sleeve of FIG. 2E showing the appearance of the sleeve as if it had been cut along its length at one side and then rolled out flat into a rectangular shape. The line 2E—2E indicates the location of the section through the sleeve which is seen in FIG. 2E.
Figure 3:
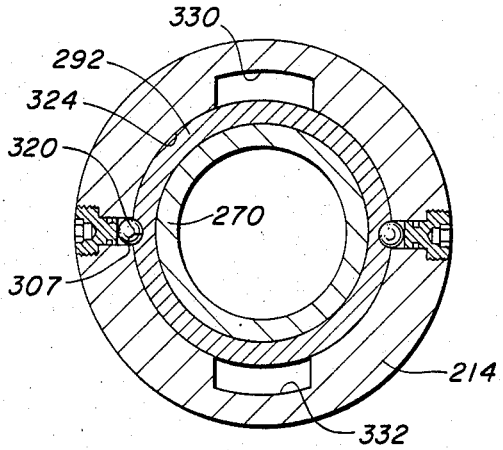
FIG. 3 is a cross-sectional view taken along lines 3—3 in FIG. 2E.

A ball 320 is biased into groove portion 302 and more particularly into the lower portion of the groove as viewed in both FIGS. 5 and 2E.

In FIG. 2E, ball 320 is mounted on the radially inner surface of an annular shoulder 324 which is formed on the radially inner surface of lower housing section 214. For a more detailed description of ball 320, its associated structure, and the manner in which ball 320 interacts with indexing sleeve 292 see U.S. Pat. No. 4,355,685 to Beck which description is incorporated herein by reference.

An annular shoulder 322 is formed on the radially inner surface of lower housing section 214 about its circumference.

Figure 4:
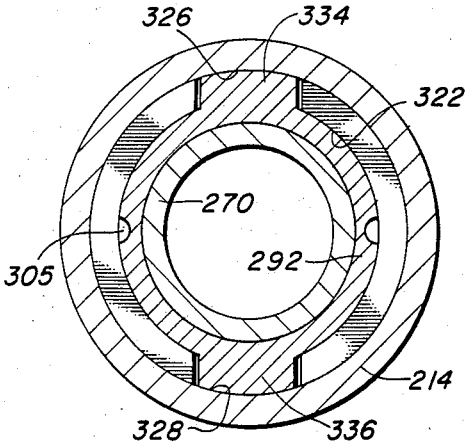
FIG. 4 is a cross-sectional view taken along lines 4—4 in FIG. 2E.

Annular shoulder 322 includes a pair of opposed slots 326, 328 which are viewable in FIG. 4.

Annular shoulder 324 includes a similar pair of opposed slots 330, 332 with slot 330 being axially aligned with slot 326 and slot 332 being axially aligned with slot 328.

Indexing sleeve 292 includes a pair of opposed load lugs 334, 336, such being viewable in FIG. 4. In the view of FIG. 4, opposing lugs 334, 336 are received within slots 326, 328, respectively. Load lug 336 is viewable in FIG. 5 and is shown in dot-dash lines in FIG. 2E, such indicating where load lug 336 is positioned on the rear side of index sleeve 292, with lug 334 being half cut away in the quarter section and half obscured by lower housing section 214.

Load lug 336 includes an upper abutment surface 338 and a lower abutment surface 340. Abutment surfaces 338, 340 comprise the upper and lower surfaces, respectively, of the load lug which extends outwardly from the radially outer surface of indexing sleeve 292.

In FIG. 2E, annular shoulder 322 includes upper and lower abutment surfaces 342, 344, respectively.

Also in FIG. 2E, shoulder 324 includes upper and lower abutment surfaces 346, 348, respectively. The upper surface of lower piston mandrel 286 comprises an abutment surface 350 with surface 348 being abutted against surface 350 in the view of FIG. 2E.

Additional abutment surfaces are seen in FIGS. 2C and 2D and include surface 352 on the lower end of lower valve sleeve 234 and surface 354 on the upper end of intermediate housing section 212. As will be explained hereinafter, the various abutment surfaces interact with one another to limit the axial movement of valve mandrel 218 and thereby place the valve in a closed condition, in a condition for circulation of fluids, or in a condition for reverse circulation of fluids.

In operation, prior to suspending tool 201 on a drill string in a well bore, mandrel 270 is axially reciprocated relative to housing 200 in order to place ball 320 in the lower end of leg 310 as shown in dashed lines in FIG. 5.

In this position ball 320 is adjacent lower surface 314. When ball 320 is in the lower portion of leg 310 adjacent surface 314, abutment surface 338 of load lug 336 and the upper surface of the opposing load lug are abutted against abutment surface 344 on the underside of annular shoulder 322. When surfaces 338, 344 are so abutted, ball 320 is not abutted against surface 314 on the lower portion of leg 310 but rather is positioned just adjacent thereto.

When power piston 270 is positioned with ball 320 in leg 310 as described above, valve mandrel 218 is positioned over circulation port 252, in FIG. 2C, between O-rings 222, 224. Thus, fluid communication between passageway 216 and the exterior of tool 201 is prevented.

With the tool configured as described above, it is assembled into the drill string and lowered into the well bore as shown in FIG. 1. With this arrangement, fluids may be pumped into the drill string on which tool 201 is suspended for purposes of fracturing or injecting acid into the formation. Also, the annulus between tool 201 and the well bore may be pressurized in order to operate different tools in the drill string testing arrangement.

With ball 320 received in the lower portion of leg 310, when fluid is pumped down the drill string upon which the tool is suspended, passageway 216 is pressurized thus forcing power mandrel 270 downwardly until ball 320 is received in the upper portion of leg 310, as shown in dashed lines in FIG. 5, adjacent surface 312. The power mandrel is urged downwardly under such pressurization due to the action of an annular piston which is defined by an outer diameter at seal 238 in FIG. 2C and by an inner diameter at O-ring 278 in FIG. 2E. Fluid pressure in passageway 216 acts across the difference in area between seal 238 and O-ring 278 to urge power mandrel 270 downwardly. As the mandrel moves downwardly ball 320 moves from the lower portion of leg 310 to the upper portion of leg 310 adjacent upper surface 312.

It is to be appreciated that downward movement of the power mandrel is stopped when lower abutment surface 340 on load lug 336 and the lower abutment surface on the opposing load lug strike upper abutment surface 346 on shoulder 324. Such occurs when ball 320 is in the position shown in dashed lines adjacent upper surface 312. Such abutment prevents ball 320 from abutting against surface 312 with a significant amount of force.

After ball 320 is positioned in the upper portion of leg 310, it may be necessary or desirable to operate a tool in the drill string testing arrangement by applying pressure to the annulus between the drill string and the well bore. Such pressure, in addition to the hydrostatic pressure in the annulus, is communicated to upper annular space 274 via port 276 in FIG. 2D and serves to urge power piston mandrel 270 upwardly relative to housing 200. When such occurs, ball 320 moves downwardly into the lower portion of the leg adjacent leg 310. Further upward piston mandrel movement is stopped by the action of abutment surface 338 against abutment surface 344 on the lower surface of annular shoulder 322.

When ball 320 is received within zig-zag portion 300, although piston mandrel 270 and thus valve mandrel 218 are reciprocated between the upper and lower portions of groove 300, circulation port 252 is always between O-rings 222, 224, thus sealing the port from fluid communication between the interior and exterior of the tool.

It can be seen that by alternately pumping down the drill string and the annulus or pumping down and releasing pressure in the drill string, ball 320 will be successively moved along zig-zag portion 300 until it is received in the upper portion of the leg to the immediate right of connecting port 306. When drill string pressure is released, the normal hydrostatic pressure in the annulus will act on power piston mandrel 270 through port 276 and urge it upwardly relative to housing 200. Thus, the annulus does not have to be pressured up to axially reciprocate the power piston mandrel 270 and move ball 320 in zig-zag portion 300 of groove 298.

When so positioned, annulus pressure may be applied or drill string pressure released to urge piston mandrel 370 upwardly thereby causing ball 320 to enter connecting portion 306 and thereafter lower leg 307 as the piston mandrel continues its upward movement. Abutment surface 338 does not strike abutment surface 344 on the lower surface of shoulder 322 as during piston mandrel reciprocation when ball 320 is received in zig-zag portion 300. This is because load lugs 334, 336 are received within slots 326, 328, in FIG. 4, and thus permit movement of ball 320 down lower leg 307.

Just prior to abutment of ball 320 against lower surface 318, abutment surface 348 on the lower side of shoulder 324 abuts against surface 350 on the upper side of lower piston mandrel 286 thus stopping further mandrel movement and preventing ball 320 from absorbing a significant axial load.

When ball 320 is in the lower end of leg 307 as shown in the solid-line view of FIG. 5 and FIG. 2E, valve mandrel 218 is positioned relative to port 252 as shown in FIG. 2C. When so positioned fluid may be reverse circulated through port 252, bore 250 (and the other bores about the perimeter of valve mandrel 218 adjacent bore 250), into annular space 248 on the radially inner surface of valve mandrel 218 and into passageway 216.

Thus, when valve mandrel 218 is in the configuration of 2C, the well may be reverse circulated but, because of the action of resilient valve portion 242, the well may not be circulated from the drill string into the annulus. When pressure in passageway 216 is greater than the pressure in the annulus, surface 242 sealingly engages the radially inner surface of the valve mandrel thus preventing flow between passageway 216 and the annulus.

Since such flow may not occur, when it is desired to place the tool in condition for circulation, passageway 216 may be pressurized (by pumping down the drill string) thus driving piston mandrel 270 downwardly and moving ball 320 upwardly in leg 307 and into leg 305 until the ball is adjacent surface 316. Just prior to impact of surface 316 with ball 320, surface 352 on the lower end of lower valve sleeve 234 abuts against surface 354 on the upper end of intermediate housing section 212 thus stopping further downward movement of piston mandrel and preventing ball 320 from bearing significant forces as a result of impact with surface 316.

When the piston mandrel is in its lowermost condition as just previously described, O-ring 220 on valve mandrel 218 is beneath circulating port 252 thus permitting circulation from passageway 216 into the well bore as follows. When pressure in passageway 216 increases above that in the annulus, fluid flows through bores 266 into annular space 264, between surface 260 and the radially outer surface of valve mandrel 218, and through port 252 into the annulus.

When so configured, if annulus pressure exceeds that of passageway 216, flow does not occur through port 252 because surface 260 sealingly engages the radially outer surface of valve mandrel 218.

If it is desired to return the tool to its closed position in which neither circulation nor reverse circulation can occur, the annulus is pressurized thus driving piston mandrel 270 upwardly and causing ball 320 to move down leg 305 and into the zig-zag portion (not shown) on surface 296 opposite zig-zag portion 300.

The tool is again in condition to permit repeated alternate applications of annulus and drill string pressure or applications and releases of drill string pressure without shifting the tool into condition for circulation or for reverse circulation. It can be seen that, in the tool of the preferred embodiment, five such alternate applications of annulus and drill string pressure or applications and releases of drill string pressure may occur before the tool is again placed in condition for reverse circulation. Thereafter, application of drill string pressure places the tool in condition for circulation to permit, for example, the spotting of fluids into the well bore adjacent tool 201. It will be apparent to one skilled in the art that more or fewer than five cycles may readily be employed by changing the slot.

It can be seen that tool 201 permits alternate pumping of fluids into the formation and operation of various tools by pressurizing the well bore without placing the tool in condition for circulation or reverse circulation until the annulus and drill string have been alternately pressurized a predetermined number of times. Such a tool permits reversing fluids out of the drill string and thereafter spotting fluids, for example nitrogen, into the well bore adjacent tool 201. Thereafter, annulus pressure can be increased to actuate other valves and/or tools in the well bore without compressing the nitrogen in the drill string.

Thus, tool 201 permits selectively reverse circulating and spotting fluids down the well while at the same time permitting application of drill string and annulus pressures to pump fluids and actuate other tools without unintentionally opening or closing the circulation valve.

It is thus seen that the downhole tool of the present invention readily achieves the ends and advantages mentioned as well as those inherent therein. While presently preferred embodiments of the invention have been specifically described for the purposes of this disclosure, numerous changes in the arrangement and construction of parts can be made by those skilled in the art which changes are encompassed within the spirit and scope of this invention which is defined by the appended claims.

I claim:

1. A circulation valve adapted to be suspended in a well bore on a pipe string comprising:

cylindrical housing having ap open longitudinal passageway therethrough and a circulation port disposed through a wall thereof;

a valve mandrel slidably received in said housing and axially movable between a first position closing said circulation port and a second position in which fluid may be circulated through said port;

annular piston means received in said housing and being operatively connected to said valve mandrel, said piston means having a first side subject to pressure in the annulus of said well bore and a second side subject to pressure in said pipe string, said piston means moving said valve mandrel toward one of said positions when the pressure on said first side exceeds the pressure on said second side and moving said mandrel toward the other of said positions when the pressure on said second side exceeds the pressure on said first side; and means for preventing movement of said valve mandrel from said first position until the pressure on each side of said piston alternately exceeds the pressure on the other side a predetermined number of times.

2. The circulation valve of claim 1 wherein said movement preventing means includes a groove and lug assembly disposed between said housing and said valve mandrel.

3. The circulation valve of claim 1 wherein said valve mandrel is axially movable toward a third position in which fluid may be circulated through said port. the other side a predetermined number of times.

4. The circulation valve of claim 3 wherein said valve mandrel includes means for preventing fluid flow from said pipe string to said well bore annulus when said valve mandrel is in said second position and means for preventing fluid flow from said well bore annulus to said pipe string when said valve mandrel is in said third position.

5. The circulation valve of claim 1 wherein said valve mandrel includes check valve means for permitting fluid circulation in one direction only between said pipe string and said well bore annulus when said valve mandrel is in said second position.

6. The circulation valve of claim 5 wherein said check valve means permits fluid circulation only from said well bore annulus to said pipe string.

7. The circulation valve of claim 6 wherein said valve mandrel is axially moveable toward a third position and wherein said valve mandrel includes second check valve means for permitting fluid circulation only from said pipe string to said well bore annulus when said valve mandrel is in said third position.

8. The circulation valve of claim 7 wherein said valve mandrel comprises a generally tubular member having first and second bores axially displaced from one another and wherein said first-mentioned check valve means is associated with said first bore and said second check valve means is associated with said second bore.

9. A method of operating a circulation valve of the type having a valve mandrel slidably disposed in a cylindrical housing and moveable from a first position closing a circulating port disposed through said housing to a second position in which fluid may be circulated through said port, said method comprising the steps of:

increasing pressure exterior of said housing relative to that interior thereof to move said valve mandrel toward one of said positions within said cylindrical housing, said pressure exterior of said housing being communicated to a first piston of said valve mandrel through a power port disposed through a wall of said cylindrical housing;

increasing pressure interior of said housing relative to that exterior thereof to move said valve mandrel toward the other of said positions within said housing, said valve mandrel having a second piston exposed to pressure interior of said housing; and preventing movement of said valve mandrel from said first position until the pressure interior of said housing alternately exceeds the pressure exterior of said housing a predetermined number of times.

10. The method of claim 9 which further includes the step of permitting circulation through said port in one direction only when said valve mandrel is in said second position.

11. The method of claim 10 which further includes the steps of:

moving said valve mandrel to a third position; and permitting circulation through said port in the other direction only when said valve mandrel is in said third position.

12. The method of claim 11 wherein the step of moving said valve mandrel to a third position corprises the step of applying fluid pressure to one of said pistons.

13. A circulation valve adapted to be suspended in a well bore on a pipe string comprising:

a cylindrical housing having an open longitudinal passageway therethrough and a circulation port disposed through a wall thereof;

a valve mandrel slidably received in said housing and moveable between a position in which fluid may flow through said circulation port only from the well bore annulus to the pipe string and a position in which fluid may flow through said circulation port only from the pipe string to the well bore annulus; and means for limiting axial movement of said valve mandrel in said housing including a groove and lug assembly associated with said valve mandrel and said housing.

14. The circulation valve of claim 13 wherein said valve mandrel is moveable to a position preventing fluid flow through said circulation port in either direction.

15. The circulation valve of claim 14 wherein said valve mandrel positions are axially spaced from one another and wherein said circulation valve further includes piston means operatively connected to said valve mandrel, said piston means being exposed to pressure interior and exterior of said housing for axially moving said valve mandrel to a selected one of said positions responsive to pressure changes across said housing.

16. The circulation valve of claim 13 wherein said groove includes a pattern which is constructed and arranged to permit alternately relatively pressurizing the interior and exterior of said housing a predetermined number of times when said valve mandrel is in a position closing said port before said valve mandrel can move to one of said other positions.

* * * * *